United States Patent [19]

Berry, Jr. et al.

[11] 3,977,109

[45] Aug. 31, 1976

[54] FREEZER RAIL TALKER

[75] Inventors: Thomas L. Berry, Jr., Deerfield; Kyle E. Mock, Mount Prospect, both of Ill.

[73] Assignee: Litho-Paint Poster Company, Chicago, Ill.

[22] Filed: Mar. 3, 1975

[21] Appl. No.: 554,682

[52] U.S. Cl. ..... 40/124.1; 40/126 A

[51] Int. Cl.[2] ..... G09F 1/00

[58] Field of Search ..... 40/10 R, 11 R, 16, 16.2, 40/16.4, 16.6, 19.5, 128, 124.1, 125, 126 A

[56] References Cited

UNITED STATES PATENTS

| | | | |
|---|---|---|---|
| 2,984,031 | 5/1961 | Giesecke | 40/124.1 X |
| 3,056,572 | 10/1962 | Gelow | 40/11 R X |
| 3,423,860 | 1/1969 | Berry, Jr. et al. | 40/16.6 |
| 3,706,150 | 12/1972 | Greenberger | 40/124.1 |
| 3,711,977 | 1/1973 | Blankenhorn | 40/124.1 |

*Primary Examiner*—Louis G. Mancene
*Assistant Examiner*—John H. Wolff
*Attorney, Agent, or Firm*—John R. Diver

[57] ABSTRACT

A display device blanked-out from a single piece of flat stock and adapted to be folded on score lines to provide a three dimensional structure generally flat comprising a base member adapted for attachment to a freezer rail or other suitable support means and to present a support arm extending outwardly therefrom to carry an integral tag having a large display area held in the line of sight of a person standing in front of the support means.

6 Claims, 9 Drawing Figures

FREEZER RAIL TALKER

BACKGROUND OF THE INVENTION

This invention relates to a display tag suitable for mounting to a freezer price rail which normally stretches along the back side top edge of an open top freezer or for mounting on any suitable upright surface such as the wall of an appliance. This display tag or talker, like its counterparts in the trade — the price rail marker or shelf talker — is intended to attract the buyer's attention and direct it to a particular item for sale.

It happens that conventional price rail markers and shelf talkers are not suitable for the open-top freezers employed in the larger grocery stores or chain stores, the freezer being a rather deep compartment and about as wide as a person could reach. The freezer rail stretches along the back side top wall of the freezer, such freezer rails being about 3 inches wide rather than simply 1-¼ inches wide as in the case of the usual price rail for shelf mounting. The usual markers or tags mounted on the freezer rail are essentially flat cards snapped into the rail too far from the viewer to act as really effective attention getters. When it is desired to direct attention to particular merchandise in the freezer, it is highly desirable to provide a rail talker in three dimensions, i.e., one which provides a base portion for attachment to the freezer rail and a three dimensional support arm extending outwardly from the rail to carry a display tag which hangs out over the merchandise in full view of a person standing in front of the freezer box.

Various attempts have been made to provide three-dimensional freezer rail talkers but they have not been fully satisfactory since the tag which is carried by the arm protruding from and mounted to the freezer rail by the base member is limited in advertising display area and in extent of outward protrusion of the arm over the freezer box arms. A small display area and a limited arm extension greatly reduces the advertising capability of these markers.

SUMMARY OF THE INVENTION

It is the purpose of this invention to provide an attention attracting means or talker of improved advertising capability. The gist of the invention lies in its inexpensive, one-piece fabrication from flat stock which can be readily folded to form a three-dimensional talker having a large display tag hanging from a rigid support arm extending outwardly from an integral base member or mounting portion and presenting a display surface that is normal to the line of vision of a person standing in front of the device on which the talker is mounted.

In the form herein shown and described, which is designed as a freezer rail talker, the supporting arm protruding to form the three-dimensional figure is folded to the shape of a channel with the web of the channel on top and having two flanges, one on each side of the channel web. The outward end of the web of the channel forms the free end of the support arm and integrally mounts the large display tag folded down from the web to a position substantially normal to the longitudinal axis of the arm. For price rail mounting, the channel flanges may be of the same width as the price rail, and may be folded to extend above or below the top of the price rail, as the case may be.

In one embodiment of the invention, the base connected end of the channel web extends rearwardly of the channel flange protions and folds down as an integral vertical extension from the top edge of a rectangular base member which is suitably dimensioned for snapping into place between the top and bottom grooves of the freezer price rail. The folded extension from the top of the rectangular base member is long enough when folded down to permit the channel web to be extended outwardly from below the top of the freezer rail groove. The channel flanges are then folded downwardly and their rear ends are secured to the base member by separate integral tabs extending from the rear ends of the flanges and inserted into suitable slots cut into the base member panel.

DESCRIPTION OF THE DRAWINGS

In order to demonstrate this invention, reference is made to the specific embodiments illustrated by the drawings, in which.

THE PREFERRED EMBODIMENT

Figure 1:
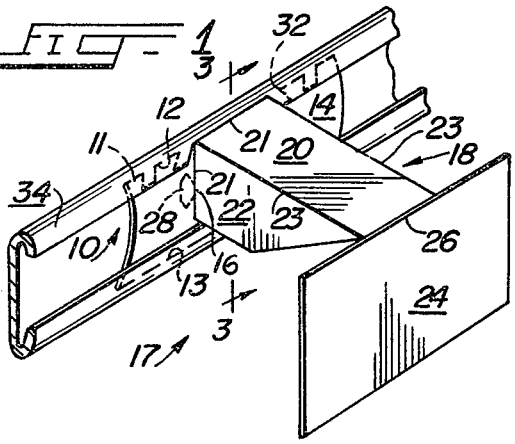
FIG. 1 is a perspective view of a conventional freezer price rail with one embodiment of the freezer price rail talker having a single rectangular base member snapped between the top and bottom price rail channels or grooves and having a display panel support arm protruding outwardly from the freezer price rail.
Figure 3:
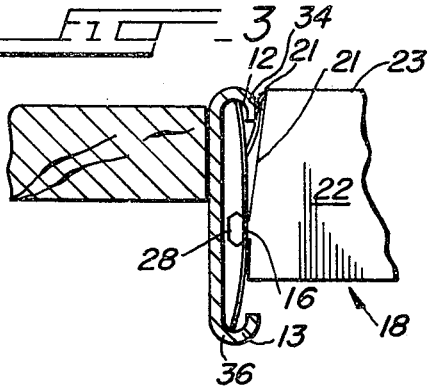
FIG. 3 is a fragmented cross-sectional view along line 3—3 of FIG. 1.

Referring to the drawings, particularly FIGS. 1 and 3, the freezer rail talker comprises a single rectangular base member 10 having a top edge 12, a bottom edge 13 and two side portions 14 adapted to be inserted into the top and bottom grooves 34 and 36, respectively, of a typical 3 inch wide freezer price rail, as shown in FIG. 3. A plurality of tabs 11 are formed in and spaced along the top margin 12 of the side portions 14, all but a central one being adapted for insertion into the price rail top groove 34, and a tab slot 16 is cut in each of the two side portions 14. A support arm 18 which protrudes from the base member 10 to carry a display tag 24 is comprised of a channel having a web 20 extending from a fold line 21 at the top edge of the central one of the base member tabs and having flange elements defined by fold lines 23. The flange elements 22 are folded down along the lines 23 of the web 20 and twin tabs 28 extend rearwardly from each of the flanges 22, as shown in FIG. 3, to engage in the tab slots 16 formed in the side portions 14 for holding the flanges 22 in vertical web supporting position. As shown in FIG. 1, the display tag 24 folds down from the free end of the web 20 along a fold line 26.

Spaced notches 32 cut in the top edge 12 of the base member 10 adjacent to the edges 23 of the web 20, as shown in FIG. 1, give clearance for the protrusion of the central tab portions of the base member margin connecting the web 20 forwardly of the top groove 34 of the price rail while the lateral tabs 11 along the edge 12 and the bottom edge 13 of the base member 10 are inserted into and held in place in the top groove 34 and the bottom groove 36, respectively.

Figure 2:
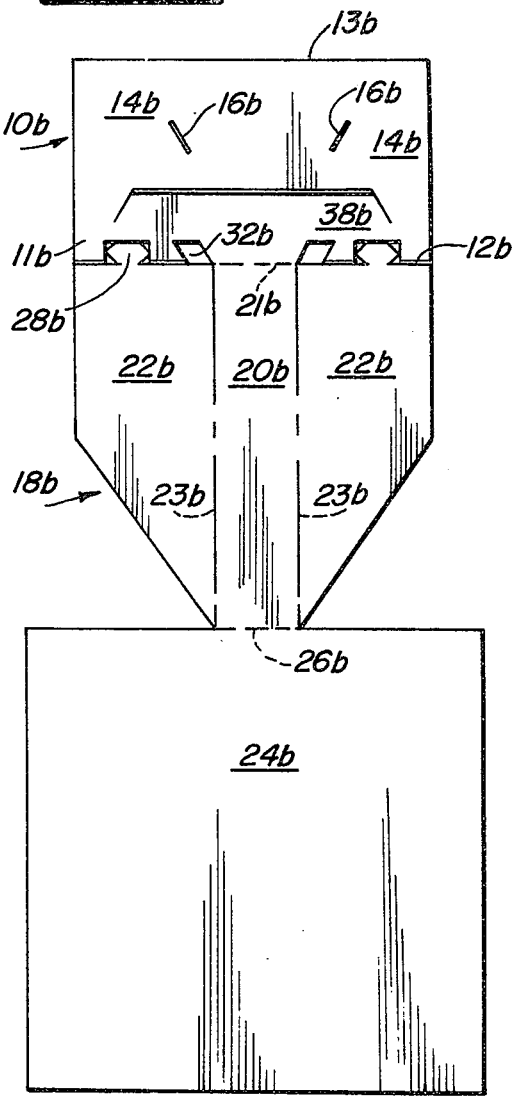
FIG. 2 shows the blank from which the price rail talker of FIG. 1 is folded, showing the fold lines as broken lines.

In the blank form, the freezer rail talker develops from a base portion **10*b* having top and bottom edges 13*b* and 12*b*, respectively, and side portions 14*b*, as shown in FIG. 2. Fold lines 23*b* (shown in broken line) defines the flange portion 22*b* of the arm portion 18*b* connecting the base portion 10*b* with the display tag 24*b*. A fold line 21*b* defines the rear end 21 of the arm portion 18*b* connecting the web portion 20*b* with the central top edge tab of the base portion 10*b*, and a fold line 26*b* defines the protruding end of the arm portion which connects the display tag 24*b* with the web portion 20*b*. The edge 12*b* and the fold line 21*b*** are coincidental in the blank form.

Twin tabs **28*b* are cut in the blank to be integral with the rear ends of the flanges 22*b* of the arm portion 18*b* and the corresponding tab slots 16*b* are located in the side portions 14*b* of the base portions 10*b* for engagement by the tabs 28*b* when the blank is folded to form the three dimensional assembly 17 shown in FIG. 1**.

When the blank is dimensioned for a 3" wide price rail, a flap **38*b* is cut in the base portion 10*b* with its free edge parallel to and spaced 1-¼ inches inward from the edge 12*b*, as shown in FIG. 2. This adapts the backing member 10 of the folded assembly 17 to mounting on a narrower 1-¼ inch price rail, the flap 38*b*** being engaged in the bottom price rail groove.

Figure 4:
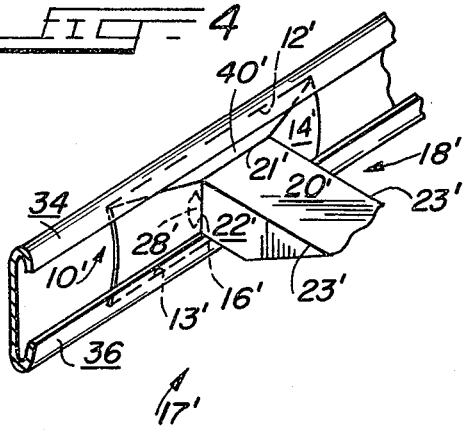
FIG. 4 is a fragmented perspective view of a second embodiment of the freezer price rail talker having a single rectangular base member snapped between the top and bottom price rail grooves and having the web of the support arm projecting from below the level of the top flange of the freezer rail.
Figure 6:
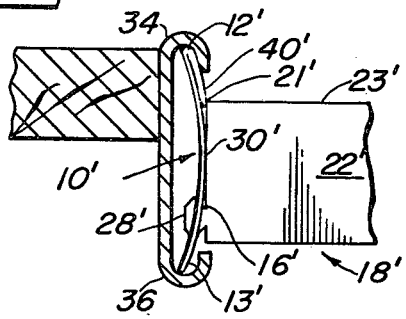
FIG. 6 is a sectional view of the embodiment of FIG. 4 showing the price rail talker base member with a tab portion folded down from its upper edge and integrally connected to the base end of the channel web to hold it clear of the top channel flange of the freezer rail.

A freezer rail talker adapted to be mounted on a 3 inch freezer price rail and which dispenses with the need for mounting tabs and clearance notches in the upper margin of the folded base member is illustrated in FIGS. 4 and 6. In this case, a base member 10' having a top edge 12', a bottom edge 13' and two side portions 14', clears the arm 18' from the top groove 34 of the price rail by lowering the base end 21' of the arm below the flange of the top groove 34 of the freezer rail by means of an extension member 40', projecting downwardly from the edge 12' of the base member 10'. A tab slot 16' is cut in each of the two side portions 14' for engagement by the tabs 28' on the flanges 22'. The top edge 12' and the bottom edge 13' of the base member 10' are inserted into the grooves 34 and 36, respectively, in the mounting of this adaptation to the freezer rail, the base member extension 40' in this adaptation being folded down from the top edge 12' of the base member 10', and the web 20' of the arm member 18' being folded out at the end 21' from the extension 40'.

The side flanges 22' are folded down along the lines 23' at the sides of the web 20' and twin tabs 28', which extend rearwardly from each of said flanges 22', engage the tab slots 16' in the side portions 14' for securing the flanges 22' on the base member 10'. As in the construction shown in FIG. 1, a display tag 24' folds down from the protruding end of the web 20' of the arm member 18'.

Figure 5:
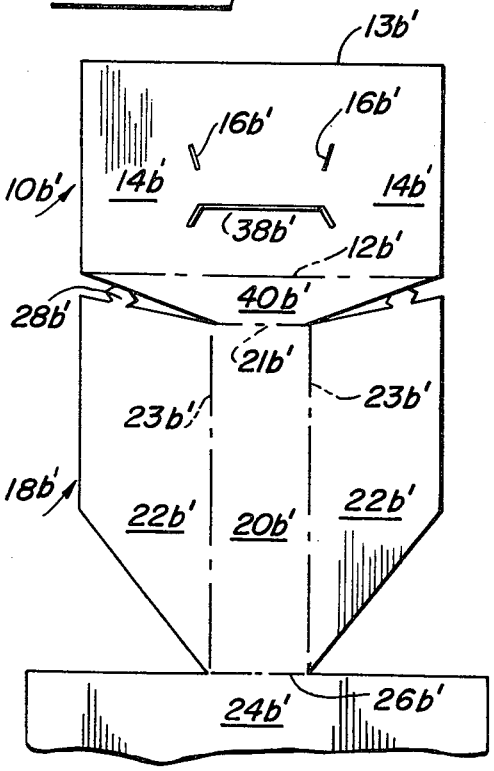
FIG. 5 shows a fragmented view of the blank from which the price rail talker of FIG. 4 is folded, showing the fold lines as broken lines.

In the blank form, the freezer rail talker of FIGS. 4 and 6 comprises a rectangular base member portion **10*b'* having edges 12*b'* and 13*b'* and side portions 14*b'*, as shown in FIG. 5, the edge 12*b'* being a scored fold line. Fold lines 23*b'* define the flange portions 22*b'* and the web 20*b'* of the support arm 18*b'* connecting the base member portion 10*b'* with the display tag portion 24*b'*. A fold line 21*b'* is formed at the rear end of the web 20*b'* which connects with the base member extension 40*b'*, and the fold line 12*b'* of the rectangular base member 10*b'* defines the extension 40*b'*. A fold line 26*b'* at the protruding end of the arm portion 18*b'* is formed for turning the display tag 24*b'*** to a hanging position.

As shown in FIG. 5, twin tabs **28*b'* are provided on the flanges 22*b'* of the arm member portion 18*b'* for connecting the base member 10*b'* by insertion through and attachment with the corresponding spaced tab slots 16*b'* formed in the side portions 14*b'*. When assembling this form of the price rail talker, the base portion extension 40*b'* is first folded down from the top edge line 12*b'* and the connecting web 20*b'* is folded upwardly therefrom at the fold line 21*b'* to give clearance below the price rail groove for the arm member 20*b'* when the blank is folded to form the three-dimensional assembly shown in FIG. 4**.

As shown, a flap **38*b'* is cut in the base member portion 10*b'* parallel to and slightly more than 2" down from the top rail line 12*b'*, to adapt the base member 10*b'* of the folded assembly 17*b'*** for mounting on a narrower 2" price rail.

Figure 8:
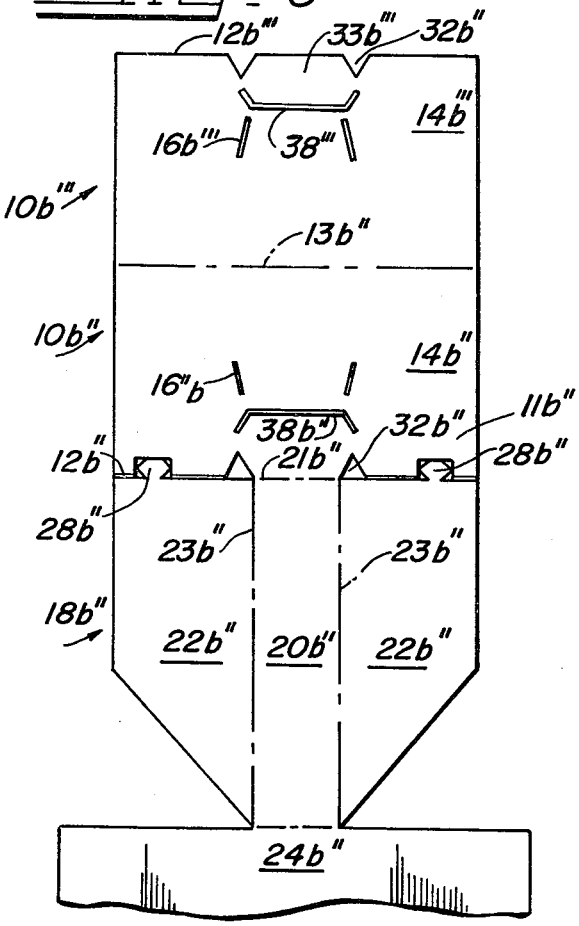
FIG. 8 is a fragmented view of the flat stock from which the freezer rail talker of FIG. 7 is formed the fold lines being shown as broken lines.
Figure 7:
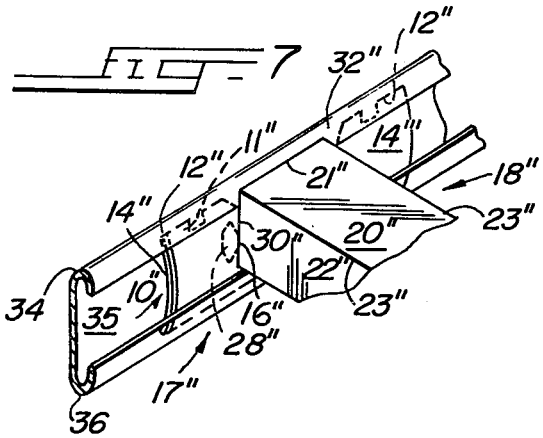
FIG. 7 is a fragmented perspective view of another embodiment of the freezer rail talker which is made to have a double folded base portion for mounting between the top and bottom freezer rail grooves in order to provide a more firm support for the display carrying arm.
Figure 9:
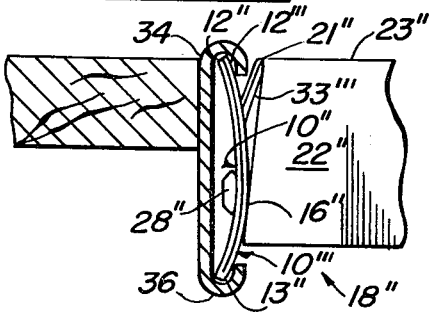
FIG. 9 is a fragmented side view of the embodiment of FIG. 7 showing the freezer rail talker with its double folded base member engaged in the price rail grooves and showing how the doubled tab elements support the display panel arm.

A further modification of our freezer rail talker adapted to be mounted into the grooves of a 3 inch freezer rail is shown in FIGS. 7, 8 and 9, this form of the device having first and second rectangular base member panels 10" and 10'" which are connected along a common folded bottom edge 13" for reinforcement and which have first and second top edges 12" and 12'", and side portions 14" and 14'" on each, the doubled base member being adapted to be inserted into the grooves on a 3" wide freezer price rail, as shown in FIGS. 7 and 9. A plurality of tabs 11" are spaced along the first top edge 12" of the side portions 14" for engagement in the top groove 34 of the price rail and matching tab slots 16" and 16'" are cut in each of the side portions 14" and 14'". A support arm 18" which protrudes from the backing member 10" to carry a display tag is in the form of a channel comprised of a web 20" extending from the base member 10", and two flange elements 22" extending along fold lines 23". The end of the flanges 22" are cut free from the base member 10" and the display tag and are folded down along the edges 23" of the web 20". Twin tabs 28" extend rearwardly from the rear end each of said flanges 22" as shown in FIG. 9, and are engaged in the tab slots at 16" in the side portions 14" and 14'" securing the flanges 22'' of the support arm 18'' to the doubled base members 10''-10'''.

Spaced notches 32'' in the first top edge 12'' of the backing member 10'', located adjacent to the fold lines 23'' of the web 20'', as shown in FIG. 7, give clearance for the protrusion of the support arm rear end 21'' outside of the top groove 34 of the price rail 35 while the first top edge 12'' and the folded bottom edge 13'' of the rectangular base members 10'' and 10''' are held in place in the top groove 34 and the bottom groove 36, respectively.

As shown in FIG. 9, the base member panel 10''' is folded upwardly at the line 13'' between the panel 10'' and the rear end of the support arm 22'' and a flap 33''' formed between laterally spaced notches in the free edge 12''' of the base panel 10''' extends upwardly under the fold line 21'' of the support arm web 23'' to provide stiffening of the support arm at the line of its connection to the doubled base member.

The blank form of the freezer rail talker of FIGS. 7 and 9 is shown in FIG. 8 and comprises base member portions **10*b*'' and 10*b*''', which are connected along a fold line 13*b*'', and have first and second free edges 12*b*'' and 12*b*''', respectively. Fold lines 23*b*'' define the longitudinal edges of the support arm web portion 20*b*'' connecting the base member panel 10*b*'' with the display tag 24*b*'', a fold line 21*b*'' defining the point of connection of the rear end of the support arm with the base member 10*b*''. The flange portions 22*b*'' of the channelform support arm 18*b*'' are cut free of the edge 12*b*'' of the base member panel 10*b*'' and are likewise free of the display tag 24*b*'' so as to be foldable relative to the web portion 20*b*'' along the lines 23*b*''**.

Twin tabs **28*b*'', which extend from the rear ends of the flanges 22*b*'' of the support arm portion 18*b*'', are cut from the margin of the base portion 10*b*'' and are located for engagement in appropriately located tab slots 16*b*'' and 16*b*''' in the base members 10*b*'' and 10*b*'''. Notches 32*b*'' and 32*b*''' in the free edges 12*b*'' and 12*b*''' of the base member portions 10*b*'' and 10*b*''', which are located in alignment with the score lines 23*b*'', provide for clearance and protrusion of the central tabs of the base member portion, the rearward one of which is attached to the support arm at the score line 21*b*'' when the blank is folded to form the three-dimensional assembly 17'', as shown in FIG. 9, the flap 33*b*''' then being disposed to project upwardly beneath the fold line 21''**.

A flap **38*b*'' is formed in the base portion 10*b*'' of the blank parallel to and slightly over 1 inch rearward from the free edge 12*b*'', as shown in FIG. 8, and a mating flap 38*b*''' is formed in the base portion 10*b*''' parallel to and slightly over 1 inch inward from the free edge 12*b*''' of the base portion 10*b*''' are disposed to match when the base portion 10*b*''' is folded under base portion 10*b*'' on the fold line 13*b*''. This arrangement of the aligned flaps 38*b*'' and 38*b*''' adapts the folded assembly 17'' (FIG. 9**) for mounting on a narrower 1 inch wide freezer price rail when such a mounting is desired.

Although the invention as herein described is essentially an attention-attracting advertising device particularly adapted for attachment to a freezer price rail or a store shelf price rail, it will be readily understood that the device may be made for mounting on any generally flat surface by simply applying a pressure-sensitive adhesive backing on the back surface of the base member. Thus, regardless of the arrangement and form of the base member, whether designed for a 3 inch freezer price rail or a conventional store shelf price rail mounting, or otherwise, a suitably protected pressure-sensitive adhesive may be applied as a standard mounting facility, thereby providing the device of this invention with capability of being mounted at substantially any desired location.

Although several specific embodiments of this invention have been herein shown and described, it will be understood that details of the forms or construction shown may be altered or omitted without departing from this spirit of the invention as defined by the appended claims.

We claim:

1. An advertising display, blanked out from a single piece of flat stock and folded for spatially supporting a display tag from a mounting surface, comprising:

a. a base member having top and bottom edges;

b. a channel-shaped support arm having its web portion foldably connected at one end to the top edge of the base member and projecting outwardly therefrom with its flange elements substantially normal thereto; and c. a display tag foldably connected to the support arm web at its free end to hang substantially normal to the longitudinal axis thereof.

2. A display device as defined in claim 1 wherein the top edge of the base member is notched at each side of its connection with the support arm to provide a tab-like element bendable from the plane of the base member in the direction of said support arm.

3. A display device as set forth in claim 2 wherein the base member comprises:

a. a generally rectangular element folded double to provide a single bottom edge and two like panels providing double top edges, one of said top edges having connection with the said support arm web and each of said top edges having laterally spaced notches therein on each side of the web connection to provide a face-to-face pair of tab-like elements securing said support arm on the double base member.

4. A display device as set forth in claim 1 wherein the top edge of the base member has an extension member foldably connected thereto and having a foldable connection with the web portion of the support arm.

5. A price rail talker blanked out from a single piece of flat stock and adapted to be folded for spatially supporting a display tag from a mounting surface, comprising:

a. a base member portion having a straight edge;

b. a support arm portion foldably connected to the straight edge of the base member portion and extending outwardly therefrom;

c. said arm portion comprising longitudinally extending web and flange portions foldable to form a channel, the web portion being connected endwise to the edge of the base member portion and the adjacent ends of the flange portions being cut free therefrom; and d. a display tag portion foldably connected to the free end of the said web portion and extending longitudinally therefrom.

6. A price rail talker as defined in claim 5 wherein the base member portion top edge has a plurality of longitudinally spaced notches forming a plurality of tabs adapted for inserting into the top groove of a price rail, one of said tabs including a centrally disposed portion of said top edge and having the foldable connection with the said support arm.

* * * * *